US010874228B1

(12) United States Patent
Awalt

(10) Patent No.: US 10,874,228 B1
(45) Date of Patent: Dec. 29, 2020

(54) SHELF COVER WITH PRICE TAG HOLDER

(71) Applicant: Barry A. Awalt, Waterville, ME (US)

(72) Inventor: Barry A. Awalt, Waterville, ME (US)

( * ) Notice: Subject to any disclaimer, the term of this patent is extended or adjusted under 35 U.S.C. 154(b) by 0 days.

(21) Appl. No.: 16/944,805

(22) Filed: Jul. 31, 2020

Related U.S. Application Data

(63) Continuation-in-part of application No. 16/684,072, filed on Nov. 14, 2019, now Pat. No. 10,765,235, and a continuation-in-part of application No. 16/520,101, filed on Jul. 23, 2019, now Pat. No. 10,765,234.

(51) Int. Cl.

| | |
|---|---|
| ***A47F 5/00*** | (2006.01) |
| ***G09F 3/20*** | (2006.01) |
| ***A47F 5/08*** | (2006.01) |
| ***A47B 96/02*** | (2006.01) |
| ***A47G 11/00*** | (2006.01) |

(52) U.S. Cl.
CPC ..... *A47F 5/0068* (2013.01); *A47B 96/021* (2013.01); *A47F 5/0018* (2013.01); *A47F 5/0043* (2013.01); *A47F 5/0869* (2013.01); *A47G 11/003* (2013.01); *G09F 3/204* (2013.01); *A47B 2220/0038* (2013.01)

(58) Field of Classification Search
CPC . G09F 3/204; G09F 3/202; G09F 3/20; G09F 7/08; G09F 7/10; Y10T 24/45105; A47F 5/0068; A47F 5/0018; A47F 5/0043; A47F 5/0062; A47F 5/0838; A47F 5/0869; A47F 5/16; A47B 55/00; A47B 96/02; A47B 96/027; A47B 96/068; A47B 96/18; A47B 96/201; A47B 96/021; A47B 97/00; A47B 13/08; A47B 13/083; A47B 13/086; A47B 2220/338; A47B 47/04; A47B 95/043; A47B 2095/046; A47B 17/022; A47B 45/00
USPC ..... 211/183, 119.003, 90.01, 72, 73, 153; 108/27, 90, 42
See application file for complete search history.

(56) References Cited

U.S. PATENT DOCUMENTS 3,241,334 A * 3/1966 Amore ..... F25D 25/021 62/382
3,637,085 A * 1/1972 Ball ..... A47B 96/021 211/153
3,647,078 A * 3/1972 Fortunato ..... A47F 5/0068 211/134
3,998,069 A * 12/1976 Kronenberger ..... F25D 17/045 62/288
4,564,548 A * 1/1986 Fast ..... A47B 96/02 428/121
4,606,280 A * 8/1986 Poulton ..... A47F 5/0068 108/152
4,698,928 A * 10/1987 Soporowski ..... G09F 7/08 40/605
5,044,104 A * 9/1991 Hopperdietzel ..... G09F 3/20 40/654.01
5,228,581 A * 7/1993 Palladino ..... A47F 3/0486 108/90
5,415,302 A * 5/1995 Carlson ..... A47B 55/02 108/147.13
5,538,147 A * 7/1996 Fucci ..... A47B 96/021 108/90

(Continued)

*Primary Examiner* — Jennifer E. Novosad
(74) *Attorney, Agent, or Firm* — Anthony D. Pellegrini

(57) ABSTRACT

A shelf cover configured to be placed onto a shelf of a shelving unit and having an integrated removable price tag holder located on its front edge.

20 Claims, 6 Drawing Sheets

(56) References Cited

U.S. PATENT DOCUMENTS 5,697,302 A * 12/1997 Putnam ..... A47B 55/02 108/90
6,126,125 A * 10/2000 Dalton ..... G09F 3/204 248/205.2
6,226,910 B1 * 5/2001 Ireland ..... G09F 3/204 40/651
6,401,945 B1 * 6/2002 Gawel ..... A47B 96/021 108/90
6,553,702 B1 * 4/2003 Bacnik ..... G09F 3/204 40/649
6,571,498 B1 * 6/2003 Cyrluk ..... G09F 3/204 108/27
6,725,785 B2 * 4/2004 Wang ..... A47B 13/08 108/90
7,063,217 B2 * 6/2006 Burke ..... A47F 1/126 211/119.003
7,810,440 B2 * 10/2010 Ward ..... A47B 96/021 108/90
7,882,969 B2 * 2/2011 Gerstner ..... A47F 5/16 211/119.003
8,069,994 B2 * 12/2011 Barkdoll ..... A47F 1/126 211/59.3
8,172,096 B2 * 5/2012 Van De Steen ..... A47B 96/02 211/119.003
8,511,488 B2 * 8/2013 Poisson ..... A47F 5/01 211/153
8,871,324 B2 * 10/2014 Hansel ..... A47B 96/021 428/99
8,925,745 B2 * 1/2015 Theisen ..... A47B 96/021 211/59.3
9,149,119 B2 * 10/2015 Hansel ..... A47B 95/04
9,585,475 B2 * 3/2017 Tines ..... A47B 95/043
10,765,234 B1 * 9/2020 Awalt ..... A47F 5/0869
10,765,235 B1 * 9/2020 Awalt ..... A47F 5/0068
2002/0170870 A1 * 11/2002 Callis ..... A47B 96/02 211/119.003
2004/0004052 A1 * 1/2004 Young ..... A47F 5/01 211/183
2004/0060883 A1 * 4/2004 Walker ..... A47F 5/005 211/119.003
2004/0200793 A1 * 10/2004 Hardy ..... A47F 5/0068 211/119.003
2004/0237369 A1 * 12/2004 Andersson ..... G09F 3/204 40/661.03
2005/0139560 A1 * 6/2005 Whiteside ..... A47B 57/586 211/119.003
2006/0054063 A1 * 3/2006 Ryan, Jr. ..... A47B 47/0083 108/27
2006/0180056 A1 * 8/2006 Dorholt ..... A47B 13/086 108/90
2007/0023374 A1 * 2/2007 Nawrocki ..... A47F 5/0846 211/90.01
2007/0044361 A1 * 3/2007 Gormley ..... G09F 3/204 40/661.03
2007/0251426 A1 * 11/2007 Li ..... A47B 55/02 108/27
2008/0017600 A1 * 1/2008 Thompson ..... A47B 96/021 211/119.003
2009/0001037 A1 * 1/2009 Wilcock ..... A47B 97/00 211/119.003
2017/0020286 A1 * 1/2017 Pierson ..... A47B 96/021

* cited by examiner

SHELF COVER WITH PRICE TAG HOLDER

CROSS REFERENCE TO RELATED APPLICATIONS

This application is a continuation in part of and claims priority to two pending patent applications, U.S. Ser. No. 16/520,101, filed Jul. 23, 2019, entitled "Shelf Cover with Price Tag Holder", by Barry A. Awalt, and U.S. Ser. No. 16/684,072, filed Nov. 14, 2019, entitled "Shelf Cover with Price Tag Holder", by Barry A. Awalt, which are hereby incorporated by reference.

BACKGROUND OF THE INVENTION

Display shelving for retail sales is well known in the art. Such shelving is typically placed in aisles, with multiple tiers of shelving. A typical style of such shelving is known as gondola shelving. Gondola shelving may be single-sided, with horizontal shelves extending outward from a vertical backing into an aisle. Gondola shelving may also be double-sided, with horizontal shelves extending outward from either side of the vertical backing into adjacent aisles. Shelving also may wrap around the ends, forming end caps.

Most shelving also makes use of price tags to identify the product placed thereon as well as the price and unit cost. Price tags are typically affixed to the front of shelving, in a substantially vertical orientation. Such placement results in difficulty in reading price tags that are affixed to shelves that are significantly below or above eye level.

For purposes of durability, retail shelving is typically made of metal. The shelving is typically painted in a monochrome color.

Retail establishments, such as supermarkets, traditionally perform center store remodels based on the aesthetics or appearance of their metal gondola shelving, not strictly because of functionality. That is, shelving slated for remodeling typically can still support and display product; the appearance, though, is deemed unacceptable. This is because, during use, shelving can over time become dirty, scratched, and dented. Colors may fade, or the finish may become chipped. While dirt can be cleaned, cleaning shelves in place is inconvenient, while bringing shelves to a proper cleaning facility requires disassembly of the entire shelving unit, as would refurbishment. Ad hoc changes to the aesthetics of the shelving, for example, to display holiday colors, is difficult, if not impossible. Replacing tired looking shelving units can be quite costly.

It is thus shown that there is a need for an improved shelving system that enables shelving units to retain high quality aesthetics and to allow for quick and easy maintenance and refurbishment. It is also shown that there is a need for better display of price tags on shelving.

SUMMARY OF THE INVENTION

The present invention discloses a shelf cover which is placed onto each shelf of a shelving unit. The shelf cover is made of a substantially rigid, durable ABS plastic and can have any color or design desired. The shelf cover can be easily removed for cleaning or replacement, or to change aesthetics seasonally, and easily replaced onto the shelving unit. Integrated with the shelf cover is a removable price tag holder.

The present invention provides substantial advantages over the traditional means for refurbishing shelving. Because the shelving does not need to be replaced, the costs of transporting away entire old shelving systems and transporting in entire new shelving systems is avoided. The disposal of entire old shelving systems is avoided, reducing costs as well as environmental harm. The labor involved in completely disassembling old shelving systems and reassembling new shelving systems is eliminated. The time it would take to remodel an entire retail establishment is drastically shortened. Most importantly, the cost to remodel shelving is greatly reduced.

The present invention provides substantial advantages over the traditional means in regards to maintenance, as well. The shelving covers can be easily removed and brought to a facility for thorough cleaning. This improves the cleanliness of the shelving system over the traditional method of simply wiping down shelving surfaces. The price tag holder can also be removed and brought to a cleaning facility and power washed to remove adhesives. This is an improvement over scraping old price tags off of shelving.

Other features and advantages of the invention are described below.

DETAILED DESCRIPTION OF INVENTION

Figure 6:
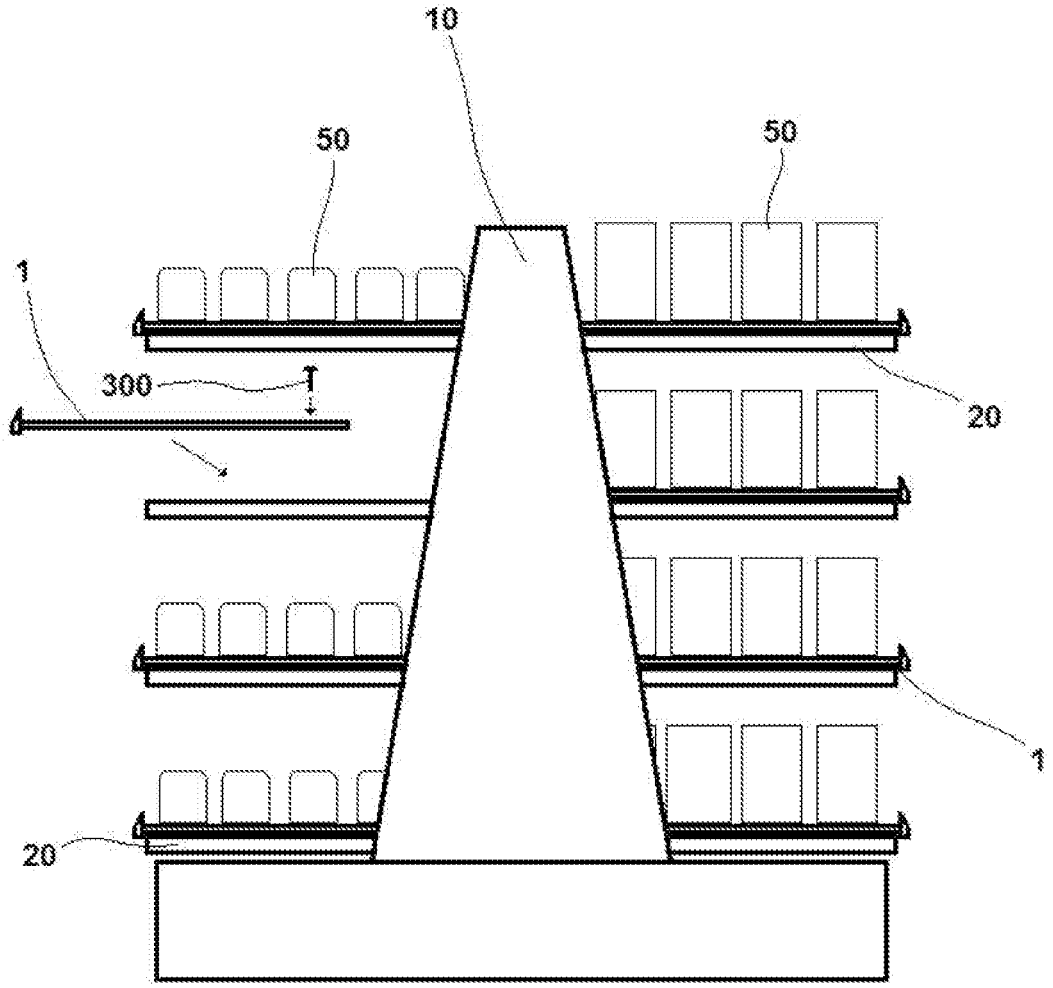
FIG. 6 is a side plan view of a gondola shelving unit with the shelf covers of the present invention placed onto the shelves of the shelving unit.
Figure 7:
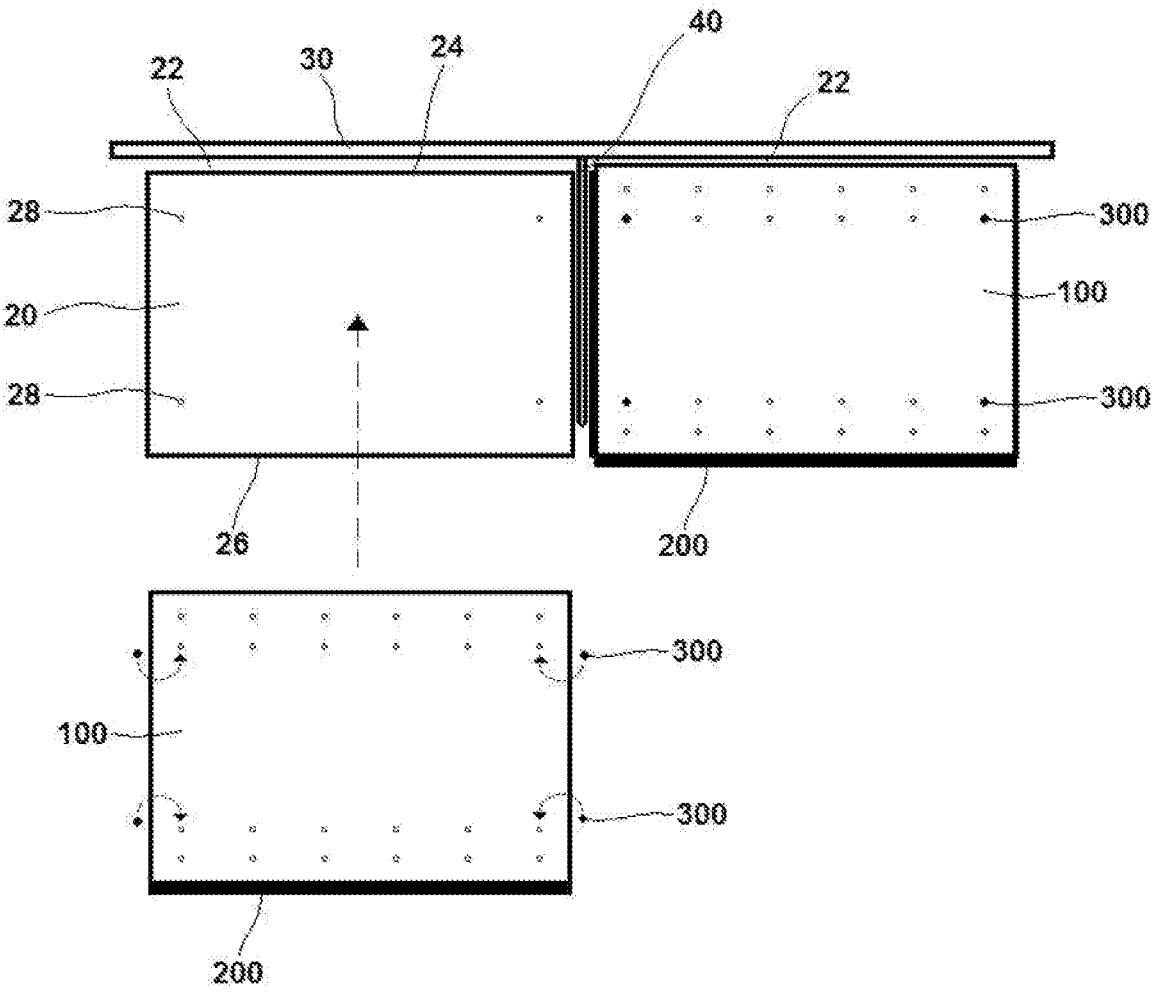
FIG. 7 is a top plan view of two shelves of a gondola shelving unit, depicting the placement of one shelf cover of the present invention onto one shelf of the shelving unit and a second shelf cover already in place on a second shelf.

In one embodiment of the present invention, a shelf cover 1 is disclosed. The shelf cover 1 is intended for use on a shelving unit 10, such as gondola shelving. The shelving unit 10 must have at least one shelf 20 having a depth and oriented substantially horizontally, and a backing element 30 oriented substantially vertically. The shelf 20 of the shelving unit 10 is attached to the backing element 30 of the shelving unit 10 at approximately a ninety degree angle. Dividers 40 may be present between horizontally adjacent shelves 10. The shelving unit 10 may have shelves 20 located on both sides of the backing element 30. There may also be multiple tiers of shelves 10. See FIG. 6. The shelf cover 1 of the present invention is configured to be placed onto a shelf 20 of the shelving unit 10. See FIGS. 6 and 7.

Figure 1A:
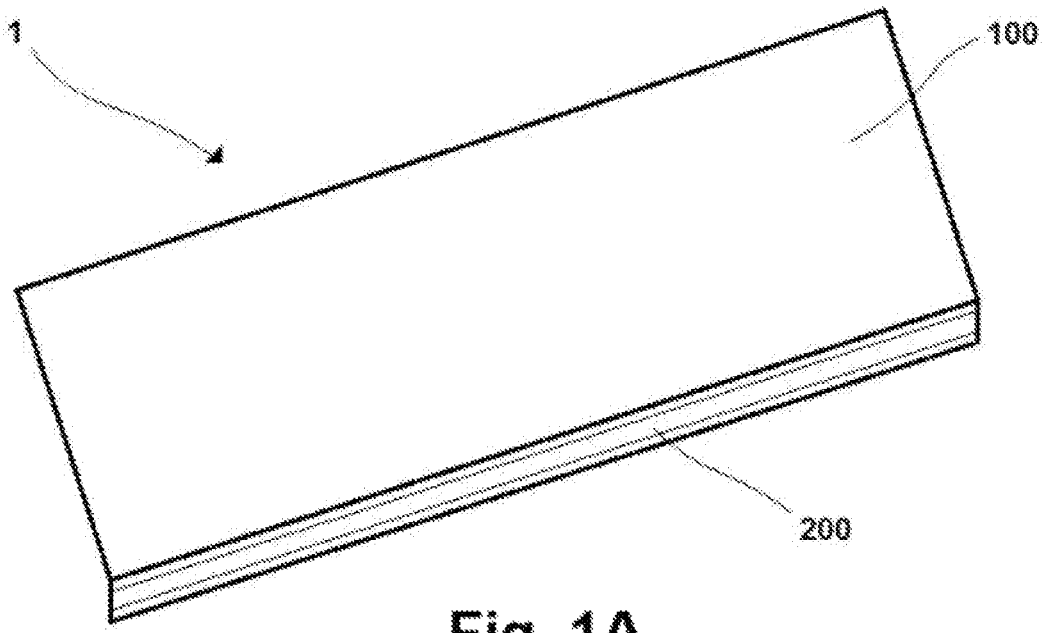
FIG. 1A is a top perspective view of one embodiment of the present invention, depicting the product support member with integrated price tag support member.
Figure 1B:
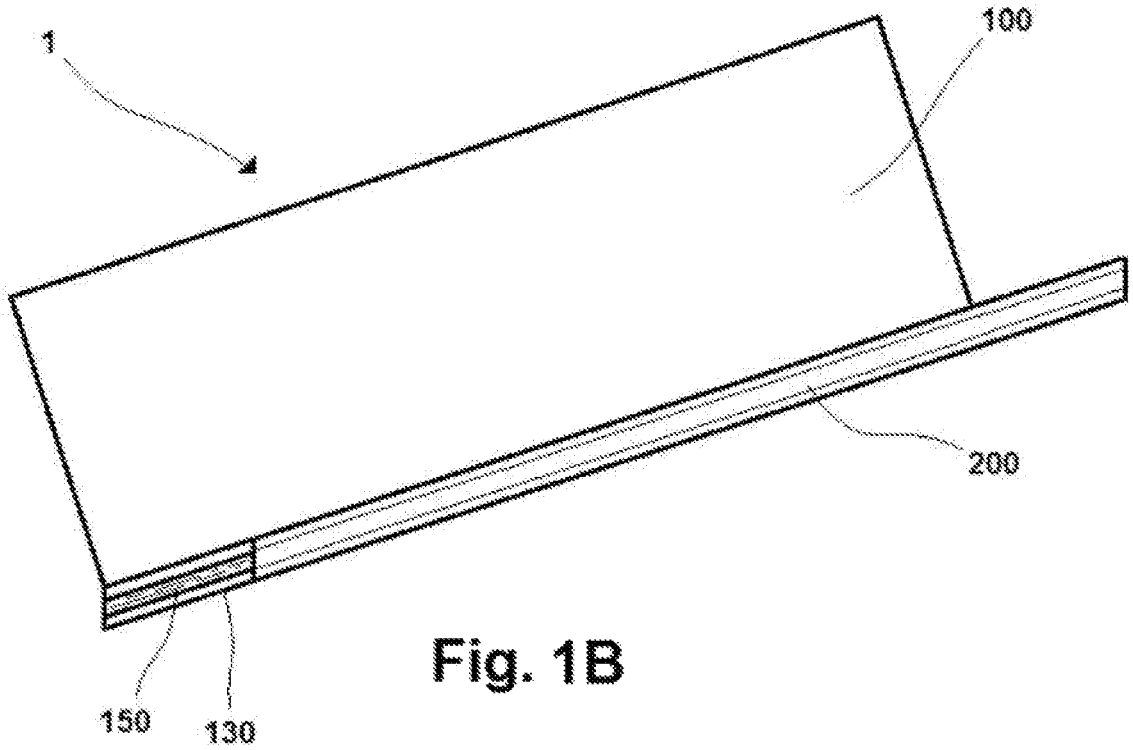
FIG. 1B is a top perspective view of the embodiment of the present invention shown in FIG. 1A, depicting the price tag support member partially removed from the product support member.

In one embodiment, the shelf cover 1 comprise a product support member 100 having an integrated a price tag support member 200. The product support member 100 is substantially planar and rigid, though some minor flexing might occur. Its thickness is relatively small in relation to its width and depth. See FIGS. 1A and 1B. The product support member 100 may be made of any suitable material; preferably, it is made from Acrylonitrile Butadiene Styrene (ABS) plastic. While the product support member 100 may have any suitable thickness, in the preferred embodiment it has a thickness of between $1/32^{nd}$ inch and $1/4^{th}$ inch, with the most preferred thickness being $1/16^{th}$ inch.

The shelf cover 1 is placed onto a shelf 20 of the shelving unit 10 such that the product support member 100 of the shelf cover 1 rests on the top surface of the shelf 20. See FIG. 7. Product 50 placed onto the shelf cover 1 also helps secure the shelf cover 1 to the shelf 20 merely by its weight.

The price tag support member 200 of the shelf cover 1 is located along the front edge 130 of the product support member 100. It is capable of supporting a price tag 60 thereon. The price tag support member 200 extends beyond the front edge 26 of the shelf 20 of the shelving unit 10. See FIGS. 6 and 7.

The shelf cover 1 of the present invention may be configured in any number of ways. In the preferred embodiment, the product support member 100 of the shelf cover 1 is substantially rectangular. Other suitable shapes are also contemplated. In another embodiment, the product support member 100 of the shelf cover 1 is monochrome; alternatively, it may be multi-colored. It may have one or more graphic designs placed on its surfaces, or text, or a combination of both. Such variations allow for different shelf covers 1 to be used during different seasons and holidays, if desired.

Figure 3A:
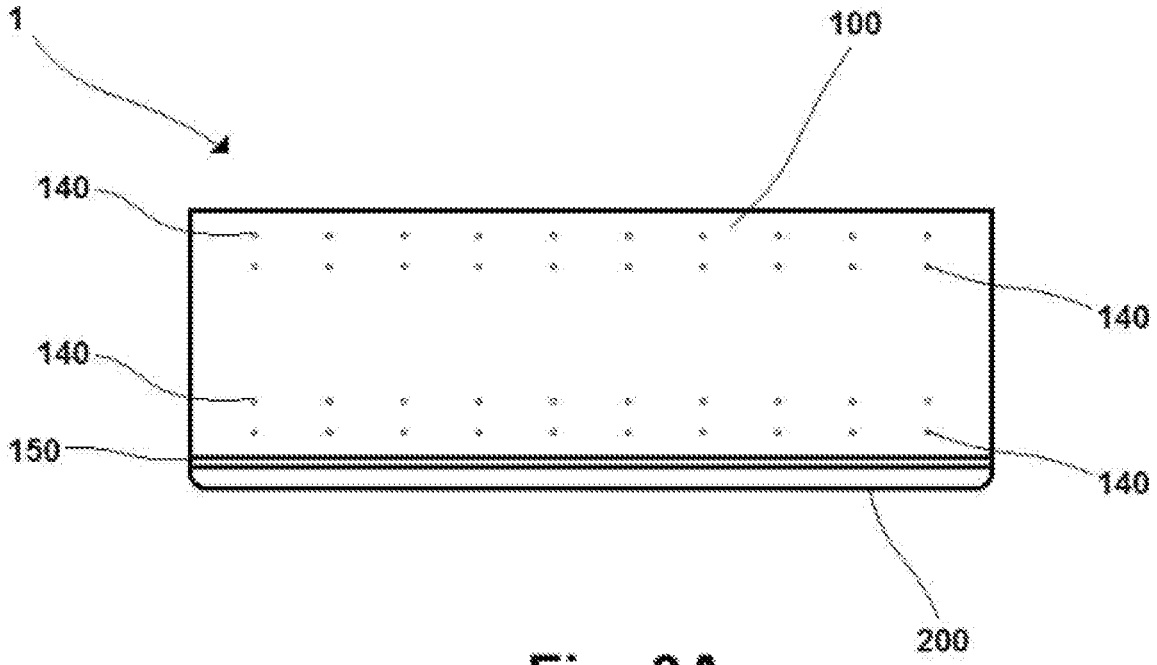
FIG. 3A is a top plan view of the embodiment of the present invention shown in FIG. 1A.
Figure 3B:
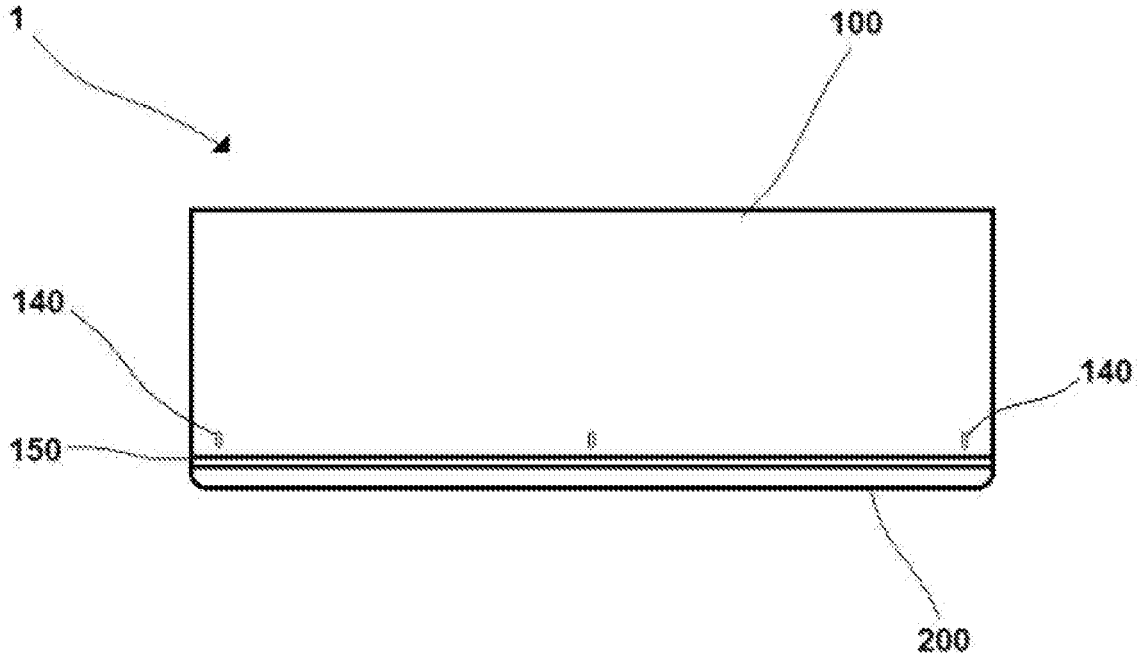
FIG. 3B is a top plan view of an alternative embodiment of the present invention shown in FIG. 1A.

In yet another embodiment, the product support member 100 of the shelf cover 1 may comprise one or more apertures 140. See FIGS. 3A and 3B. Each of the apertures 140 passes all the way through the thickness of the product support member 100. These apertures 140 allow components of the shelving unit 10, such as dividers, "pushers", tags, and the like, to be attached to a shelf 20 that is covered by the shelf cover 1 through the apertures 140 formed into the shelf cover 1. In one variant at least one of each aperture 140 is substantially circular, and one or more rows of multiple apertures 140 are located on the product support member 100. See FIG. 3A. In another variant, at least one of each aperture 140 is elongate. See FIG. 3B. Other configurations of the apertures 140 are also contemplated.

In embodiments where the product support member 100 of the shelf cover 1 comprises one or more apertures 140, one or more fasteners 300 may be used. Each fastener 300 is configured to pass through an aperture 140 of the product support member 100 and into a corresponding aperture 28 in the shelf 20. See FIGS. 6 and 7. The fasteners 300 help stabilize the shelf cover 1 and limit lateral movement thereof. In the preferred embodiment, the fasteners 300 are configured to fit into the apertures 140 of the product support member 100 and into the apertures 28 of the shelf 20 with very tight tolerances, thereby causing a friction fit of the fasteners 300 into the apertures 28,140. Such eliminates the need for a securing member to hold the fastener 300 in place, simplifying installation and de-installation of the shelf cover 1.

Figure 4A:
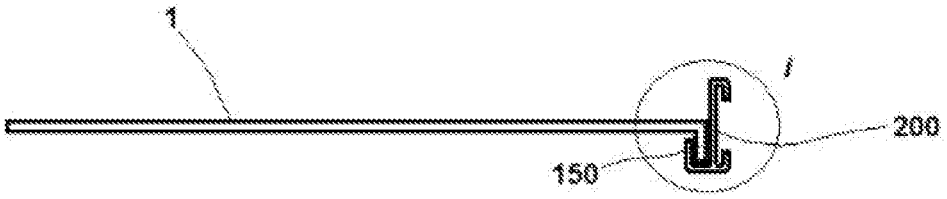
FIG. 4A is a side plan view of an embodiment of the present invention shown depicting the price tag support member attached to the front edge of the product support member.
Figure 4B:
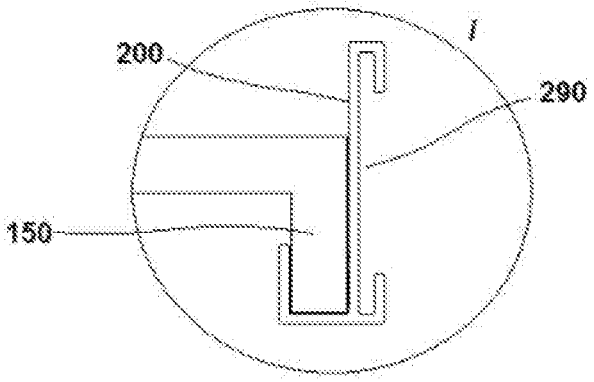
FIG. 4B is an enlarged side plan view of area i of the embodiment of the present invention shown in FIG. 4A.
Figure 5A:
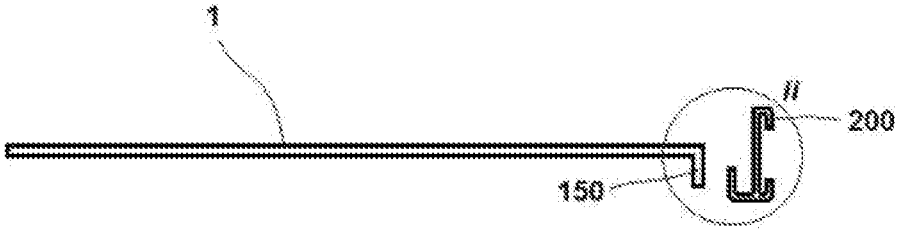
FIG. 5A is a side plan view of the embodiment of the present invention shown in FIG. 4A depicting the price tag support member detached from the front edge of the product support member.

In one embodiment, the product support member 100 and the price tag support member 200 are comprised of a monolithic unit. As such, the shelf cover 1 can be thermosformed or extruded or otherwise created in one piece with a minimum of labor required. In the preferred embodiment, though, the price tag support member 200 is removably attached to the front edge 130 of the product support member 100. In this embodiment, the product support member 100 comprises an attachment flange 150 located along its front edge 130. The attachment flange 150 is substantially planar and does not have any forward facing protrusions. It is angled in a downward direction from the product support member 100. The price tag support member 200 further comprises a single channel 210 which accommodates a lower edge of the attachment flange 150 of the product support member 100. See FIGS. 4A, 4B, 5A, and 5B. The attachment flange 150 of the product support member 100 and the channel 210 of the price tag support member 200 must be configured symmetrically in order to allow the price tag support member 200 to be attached to the product support member 100. So configured, the price tag support member 200 is attached to the product support member 100 by inserting the lower edge of the attachment flange 150 of the product support member 100 into the channel 210 of the price tag support member 200. See FIGS. 4A and 5A.

Figure 2:
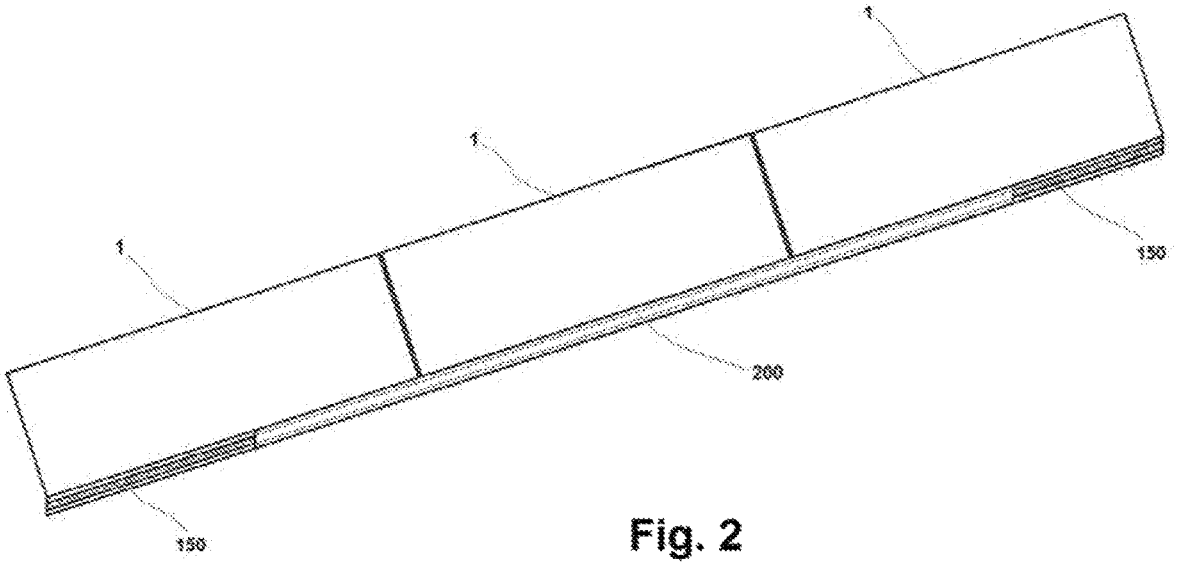
FIG. 2 is a top perspective view of the embodiment of the present invention shown in FIG. 1A, depicting multiple product support members joined together by a single elongated price tag support member.

The price tag support member 200 need not have a length equal to the width of the product support member 100. In one embodiment the price tag support member 200 may be significantly longer than the width of the product support member 100. See FIG. 2. A longer price tag support member 200 can be placed onto the attachment flanges 150 of more than one product support member 100 at a time, thereby providing a means for securing multiple shelf covers 1 to each other. See FIG. 2. In the same manner, a price tag support member 200 may be shorter than the width of the product support member 100, to fill in the end gap of a line of shelves (see, e.g., the relatively short portions of shelf covers 1 left exposed in FIG. 2).

In the preferred embodiment of the present invention, the attachment flange 150 of the product support member 100 is angled substantially ninety degrees from the product support member 100 in a downward direction. See FIGS. 4A and 5A. Alternatively, the attachment flange 150 may be angled between 60 degrees and 120 degrees from the product support member 100 in a downward direction. The attachment flange 150 should have a uniform thickness. Preferably, the attachment flange 150 is rectangular in shape. The price tag support member 200 in this embodiment is configured as an elongate body oriented substantially vertically. The elongate body has a back surface, a front surface, a top portion, a bottom portion, an upper lip 282, and a lower lip 284. The back surface of the body of the price tag support member 200 is oriented towards the attachment flange 150 of the product support member 100, the channel 210 of the price tag support member 200 is located along the back surface of the body of the price tag support member 200 proximate to the bottom portion of the body, the upper lip 282 is located along the front surface of the body proximate to the top portion of the body and extends forward and downward from the top portion of the body, and the lower lip 284 is located along the front surface of the body proximate to the bottom portion of the body and extends forward and upward from the bottom portion of the body.

Figure 5B:
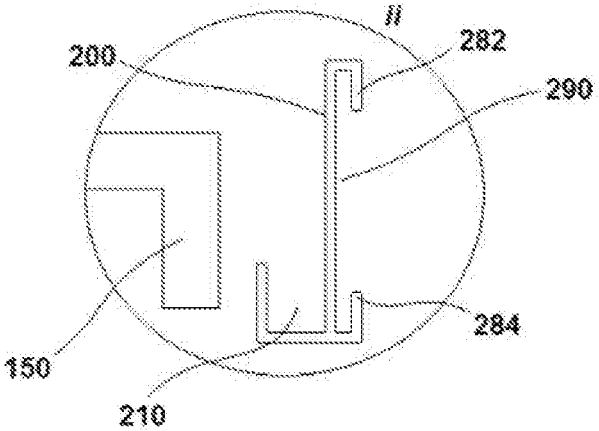
FIG. 5B is an enlarged side plan view of area ii of the embodiment of the present invention shown in FIG. 5A.

See FIG. 5B. A channel 290 is formed upon the front surface of the body, into which an elongate, planar price tag 60 can be inserted and held in place by the upper lip 282 and lower lip 284. The channel 210 of the price tag support member 200 is concave with a "U" cross section. See FIG. 5B. The lower portion of the attachment flange 150 is configured to snugly fit into the channel 210 of the price tag support member 200, such that it is retained in place by frictional forces. This configuration allows for just a single channel 210 to be used, thereby simplifying manufacturing of the device and improving ease of use. Such is an improvement over prior art configurations that require multiple channels to attach a price support member to a product support member.

In a variant on the preferred embodiment, located within the concavity of the channel 210 of the price tag support member 200 is a plurality of gripping flanges. Each gripping flange extends inward from the inner surface of the channel 210 into the concavity of the channel 210, and is further oriented downward towards the bottom of the channel 210. This configuration improves the retention of the attachment flange 150 within the channel 210.

In yet another variant of present invention, there is disclosed a shelf assembly which is comprised of a shelf together with the removable shelf cover as described herein.

What has been described and illustrated herein are preferred embodiments of the shelf cover of the present invention along with some it its variations. The terms, descriptions and figures used herein are set forth by way of illustration only and are not meant as limitations. Those skilled in the art will recognize that many variations are possible within the spirit and scope of the invention in which all terms are meant in their broadest, reasonable sense unless otherwise indicated. Other embodiments not specifically set forth herein are also contemplated.

I claim:

1. A shelf cover to be used with a shelving unit, said shelving unit having at least one shelf oriented substantially horizontally and having a backing element oriented substantially vertically, with the shelf of the shelving unit attached to the backing element of the shelving unit, said shelf cover comprising a product support member, said product support member being substantially planar and rigid and having a width and a thickness, wherein the product support member comprises an attachment flange located along the front edge of the product support member, with the attachment flange being substantially planar with a smooth front surface and without any forward facing protrusions, and angled in a downward direction from the product support member such that no portion of the attachment flange extends above the product support member; and a price tag support member, said price tag support member located along a front edge of the product support member and capable of supporting a price tag thereon, wherein the price tag support member is removably attached to a lower portion and only said lower portion of the attachment flange of the product support member;

whereby the shelf cover is adapted to be placed onto the shelf of the shelving unit and the product support member of the shelf cover is adapted to rest on a top surface of the shelf of the shelving unit, and the price tag support member of the shelf cover is adapted to extend beyond a front edge of the shelf of the shelving unit.

2. The shelf cover of claim 1 wherein the product support member of the shelf cover comprises an aperture, said aperture passing through the thickness of the product support member.

3. The shelf cover of claim 2 wherein the aperture of the product support member of the shelf cover is substantially circular in shape.

4. The shelf cover of claim 2 wherein the aperture of the product support member of the shelf cover is elongate in shape.

5. The shelf cover of claim 2 further comprising a fastener, said fastener configured to pass through the aperture of the product support member.

6. The shelf cover of claim 5, wherein said fastener is configured to pass through an aperture formed into the shelf, whereby said aperture formed into the shelf through which said fastener is passed aligns with the aperture of the product support member.

7. The shelf cover of claim 1 wherein the product support member of the shelf cover comprises a plurality of apertures, each said aperture passing through the thickness of the product support member.

8. The shelf cover of claim 7 wherein at least one of the plurality of apertures of the product support member of the shelf cover is substantially circular in shape.

9. The shelf cover of claim 7 wherein at least one of the plurality of apertures of the product support member of the shelf cover is elongate in shape.

10. The shelf cover of claim 7 further comprising one or more fasteners, each such fastener configured to pass through one of the plurality of apertures of the product support member.

11. The shelf cover of claim 10, wherein each such fastener is configured to pass through one of a plurality of apertures formed into the shelf, whereby each of said plurality of apertures formed into the shelf through which a fastener is passed aligns with one of the plurality of apertures of the product support member.

12. The shelf cover of claim 1 wherein the price tag support member consists of a single channel which accommodates the attachment flange of the product support member, said single channel located proximate to a bottom portion of said price tag support member;

wherein the price tag support member is attached to the product support member by inserting a lower edge of the attachment flange of the product support member into the single channel of the price tag support member.

13. The shelf cover of claim 12 wherein the channel of the price tag support member is located along the bottom portion of the price tag support member and is concave with an upper opening and a closed lower surface thereby forming a U-shaped cross-section;

such that the lower edge of the attachment flange of the product support member fits within the channel of the price tag support member and is secured therein by frictional forces in a fixed relative orientation thereto.

14. The shelf cover of claim 1 wherein the price tag support member further comprises an elongate body, having a back surface, a front surface, a top portion, a bottom portion, an upper lip, and a lower lip;

wherein the back surface of the body of the price tag support member is oriented towards the product support member, the upper lip is located along the front surface of the body of the price tag support member proximate to the top portion of the body of the price tag support member and extending forward and downward from the top portion of the body, and the lower lip is located along the front surface of the body of the price tag support member proximate to the bottom portion of the body of the price tag support member and extending forward and upward from the bottom portion of the body, such that a channel is formed upon the front surface of the body whereby an elongate, planar price tag can be inserted into said channel and held in place by the upper lip and lower lip, and the body of the price tag support member is removably attached to the attachment flange of the product support member.

15. The shelf cover of claim 14 wherein the price tag support member consists of a single channel formed onto the back surface of the body of the price tag support member which accommodates the attachment flange of the product support member, said single channel located proximate to a bottom portion of said price tag support member;

wherein the price tag support member is attached to the product support member by inserting a lower edge of the attachment flange of the product support member into the single channel of the price tag support member.

16. The shelf cover of claim 15 wherein the channel of the price tag support member is located along the bottom portion of the price tag support member and is concave with an upper opening and a closed lower surface thereby forming a U-shaped cross-section;

such that the lower edge of the attachment flange of the product support member fits within the channel of the price tag support member and is secured therein by frictional forces in a fixed relative orientation thereto.

17. A shelf assembly to be used with a shelving unit, said shelving unit having a backing element oriented substantially vertically and said shelving unit further adapted to have at least one said shelf assembly affixed thereto, said shelf assembly comprising a shelf, said shelf adapted to be positioned within the shelving unit in a substantially horizontal orientation, with said shelf adapted to be attached to the backing element of the shelving unit; and a removable shelf cover, said shelf cover comprising a product support member, said product support member being substantially planar and rigid and having a width and a thickness, wherein the product support member comprises an attachment flange located along the front edge of the product support member, with the attachment flange being substantially planar with a smooth front surface and without any forward facing protrusions, and angled in a downward direction from the product support member such that no portion of the attachment flange extends above the product support member; and a price tag support member, said price tag support member located along a front edge of the product support member and capable of supporting a price tag thereon, wherein the price tag support member is removably attached to a lower portion and only said lower portion of the attachment flange of the product support member;

whereby the shelf cover of the shelf assembly is adapted to be placed onto said shelf of the shelf assembly and the product support member of the shelf cover is adapted to rest on a top surface of the shelf of the shelf assembly, and the price tag support member of the shelf cover of the shelf assembly is adapted to extend beyond a front edge of the shelf of the shelf assembly.

18. The shelf assembly of claim 17 wherein the product support member of the shelf cover of the shelf assembly comprises one or more apertures, each said aperture passing through the thickness of the product support member.

19. The shelf assembly of claim 17 wherein the price tag support member of the shelf cover of the shelf assembly consists of a single channel which accommodates the attachment flange of the product support member of the shelf cover of the shelf assembly, said single channel located proximate to a bottom portion of said price tag support member;

wherein the price tag support member is attached to the product support member by inserting a lower edge of the attachment flange of the product support member into the single channel of the price tag support member.

20. The shelf assembly of claim 19 wherein the channel of the price tag support member of the shelf cover of the shelf assembly is located along the bottom portion of the price tag support member and is concave with an upper opening and a closed lower surface thereby forming a U-shaped cross-section;

such that the lower edge of the attachment flange of the product support member fits within the channel of the price tag support member and is secured therein by frictional forces in a fixed relative orientation thereto.

* * * * *